United States Patent [19]

Dickhart, III et al.

[11] Patent Number: 4,555,095

[45] Date of Patent: Nov. 26, 1985

[54] ISOLATOR FOR A SPRING IN A RAILWAY CAR

[75] Inventors: William W. Dickhart, III, Ft. Washington, Pa.; Dante J. Graziani, Jr., W. Berlin, N.J.; James M. Herring, Jr., Merion Station; Michael J. Pavlick, Norristown, both of Pa.; Edward J. Renn, Churchville, Pa.

[73] Assignee: The Budd Company, Troy, Mich.

[21] Appl. No.: 588,617

[22] Filed: Mar. 12, 1984

[51] Int. Cl.[4] ..... F16F 1/12

[52] U.S. Cl. ..... 267/4; 267/170

[58] Field of Search ..... 267/4, 33, 60, 61 R, 267/167, 168, 170, 178, 179

[56] References Cited

U.S. PATENT DOCUMENTS 1,956,108 4/1934 Symington et al. ..... 267/4

3,169,757 2/1965 Roder et al. ..... 267/170

3,201,143 8/1965 Drong ..... 267/33 X 3,601,063 8/1971 Dean ..... 267/4 X

FOREIGN PATENT DOCUMENTS 527468 10/1940 United Kingdom ..... 267/33

*Primary Examiner*—Duane A. Reger

*Attorney, Agent, or Firm*—Edward M. Farrell; Herman Foster; T. I. Davenport

[57] ABSTRACT

A mounting member is disposed on one end of a mechanical spring to prevent vibrations from a truck being transmitted into a car body for transmitted to the spring and car body if mounted below the spring. The mounting includes a pair of elastomeric rings, with one of the rings providing vertical compliance and the other providing lateral compliance between the truck and car body.

5 Claims, 2 Drawing Figures

ISOLATOR FOR A SPRING IN A RAILWAY CAR

BACKGROUND OF THE INVENTION

Elastomeric members have been used with mechanical springs in railway cars. Some patents which disclose such arrangements include U.S. Pat. Nos. 3,924,540; 2,640,536; and 3,361,087. Also, a U.S. Pat. No. 3,211,468, not related to railway cars, discloses a solid elastic cushion over a spring housing.

A problem in many railway systems involving mechanical springs is that the springs have a tendency to vibrate and are subject to sudden surges.

The forces generated by the vibrations in the truck and spring surfaces are transmitted to the car body to add to the general discomfort of the passengers riding the car. These forces generated generally result from vertical and lateral vibrations.

OBJECTS OF THE INVENTION

It is an object of this invention to provide an improved isolating arrangement for minimizing the forces resulting from vibrations and spring surges which are transmitted to a railway car body.

It is a further object of this invention to provide an improved isolator arrangement which minimizes the vertical and lateral forces which are transmitted from the truck and mechanical springs to the car body.

BRIEF SUMMARY OF THE INVENTION

In accordance with the present invention, a mounting is disposed on one end of a spring which is disposed between a truck and a car body. A cylindrical body extends from the car body or truck partly into the spring and is connected to a circular plate having a central opening. A second circular plate having a central opening therein engages the spring and is connected to a second cylindrical body which also extends partly into the spring. An elastomeric ring is connected between the first and second plates and a second elastomeric ring is connected between the first and second cylindrical bodies.

Other objects and advantages of the present invention will be apparent and suggest themselves to those skilled in the art, from a reading of the following specification and claims, taken in conjunction with the accompanying drawings.

DESCRIPTION OF THE INVENTION

Figure 1:
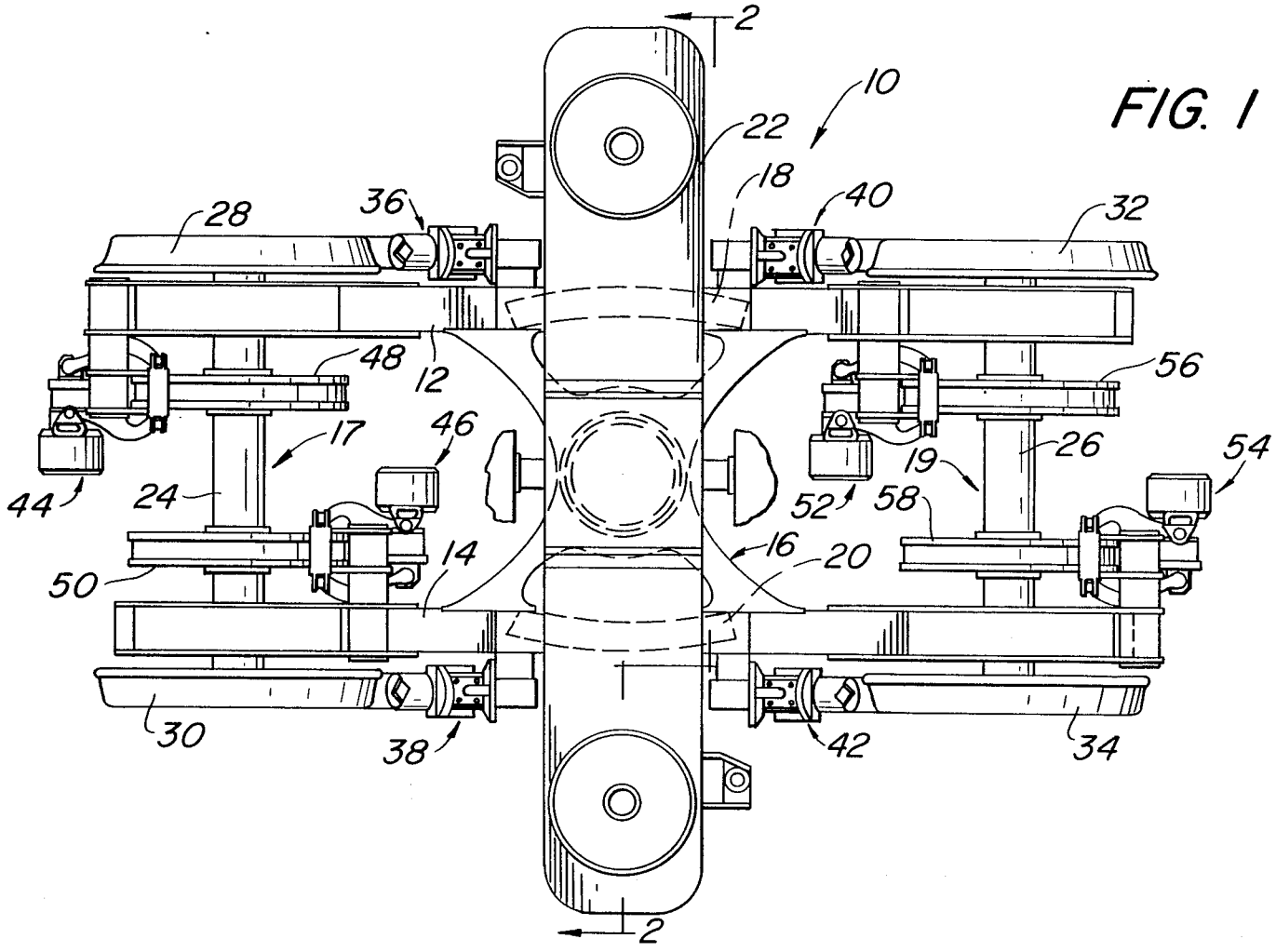
FIG. 1 is a top view of a railway truck, in accordance with the present invention.

Referring to FIG. 1, an inboard truck 10 includes side frames 12 and 14 connected by a spider-like centrally disposed transverse member 16. Sliders 18 and 20 are disposed under a bolster 22.

A typical inboard truck 10 provides considerably less room than an outboard truck between the side frames 12 and 14 and in the areas between the axles of the wheel-axle units 17 and 19 and center portions of the truck 10. In order to provide a maximum open area for maintenance of the braking system, a staggered braking arrangement illustrated in employed.

Axles 24 and 26 are connected through journal box assemblies which are secured to the ends of the side frames 12 and 14. The journal box assembly may be of the type illustrated in a U.S. Pat. No. 4,338,865 issued July 13, 1982. The axle 24 includes wheels 28 and 30. The axle 26 includes wheels 32 and 34.

Tread breaks 36, 38, 40 and 42 are disposed to apply braking forces to the wheels 28, 30, 32 and 34, respectively. All of the tread brakes are disposed between the wheels and the bolster 22. This has the advantage that the tread breaks do not overhang and lengthen the length of the truck on the exposed side outside of the side frames.

Disc brakes 44 and 46, including the discs 48 and 50 mounted to the axle 24, are disposed on opposite sides of the axle 24. Disc brakes 52 and 54, including discs 56 and 58 mounted to the axle 26, are disposed on opposite sides of the axle 26.

The staggered arrangement of the disc brakes 44, 46, 52 and 54 provides space inside of the axles 24 and 26 between the axles and center of the truck to permit maintenance to be performed on the brakes.

Figure 2:
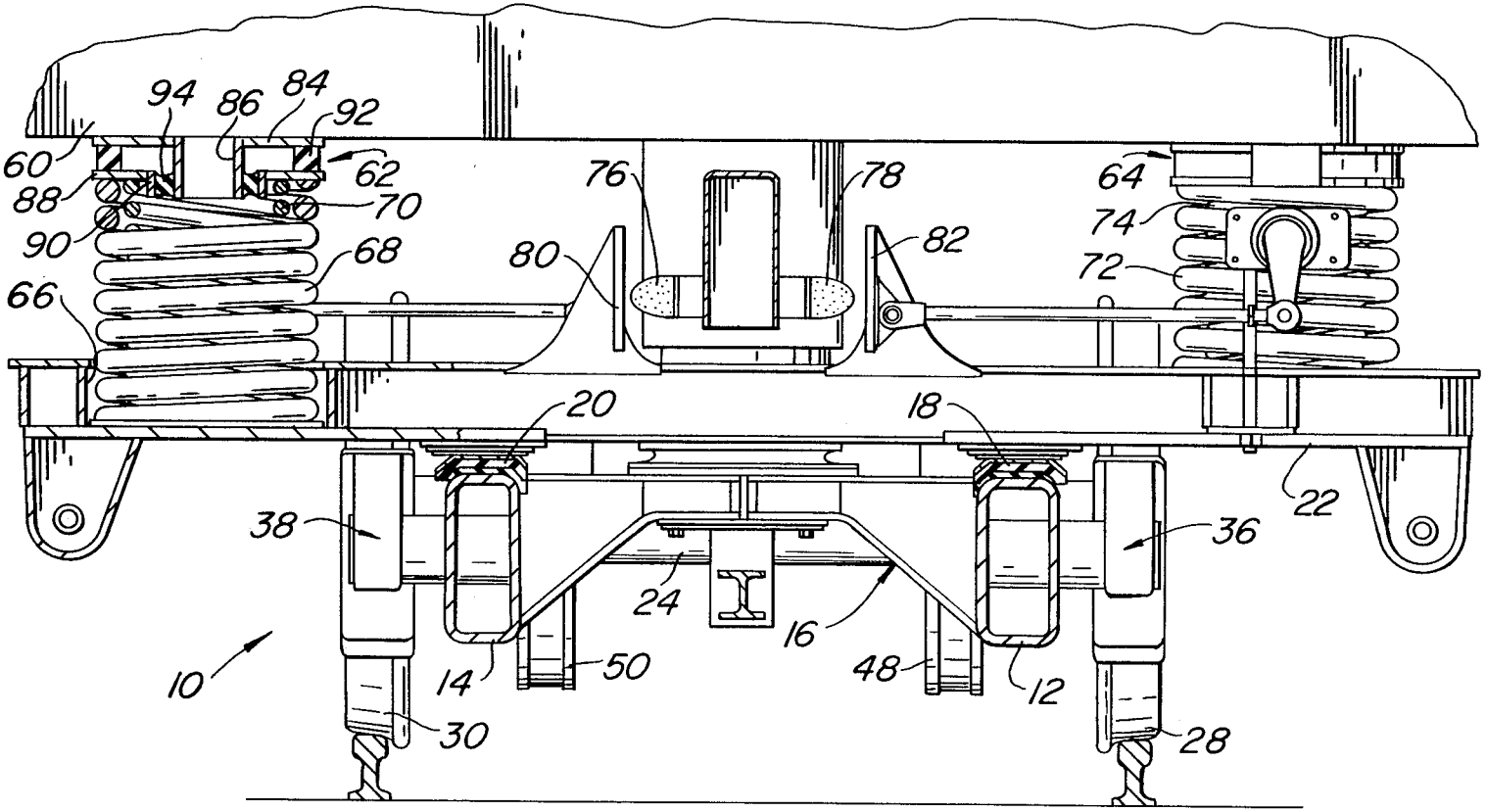
FIG. 2 is a cross-sectional view taken along lines 2—2 of FIG. 1 illustrating the truck and showing additional elements not included in FIG. 1.

Referring to FIG. 2, additional elements not illustrated in FIG. 1 include a car body 60 supported through a pair of mounting members 62 and 64 by mechanical springs disposed within spring seats, such as spring seat 66 on the bolster 22.

The mechanical springs comprise two pairs of springs 68, 70 and 72, 74. The inner springs 70 and 74 are disposed within the outer springs 68 and 72.

A pair of lateral bumpers 76 and 78 are connected to the bolster 22 between stop or limiting members 80 and 82, respectively. These bumpers and stop members limit the lateral movements of the car body 60 with respect to the truck 10.

Many details associated with the truck 10 are not illustrated or described in detail because they are conventional and only indirectly related to the present invention.

The mounting members 62 and 64 are substantially the same and both operate in similar manners. Therefore, only the member 62 will be described in detail, it being understood that the description also applies to the mounting member 64.

The mounting member 62 is disposed on top of the mechanical springs 68 and 70. A top plate 84, having a central opening therein, includes a downwardly extending cylindrical piece 86 secured thereto. The top plate 84 engages the bottom portion of the car body 60. The cylindrical piece 86 extends downwardly between the mechanical springs 68 and 70.

A bottom plate 88, having a central opening therein larger than the opening in the top plate 84, includes a downwardly projecting cylindrical piece 90 secured thereto. The piece 90 extends downwardly between the mechanical springs 68 and 70.

The top plate 84 and bottom plate 88 are spaced from each other to receive an elastomeric ring 92 therebetween. Likewise, the inner and longer cylindrical piece 86 is spaced from the outer and shorter cylindrical piece 86 to receive an elastomeric ring 94 therebetween.

The elastomeric rings 92 and 94 are disposed to provide isolation and damping between the springs 68, 70 and the car body 60. The elastomeric ring 92 provides damping of vertical vibrations and spring surges developed in the mechanical springs 68 and 70 and prevents the vibrations from being transmitted into the car body 60. The elastomeric ring 94 provides damping of lateral vibrations and spring surges in the springs 68 and 70 and prevents the vibrations from being transmitted to the car body 60.

The advantage in having the mounting means on top of the springs is that isolation for the car body is provided to prevent vibrations from the springs and the truck. In some cases, the mounting means may be disposed on the bottom of the springs. In this case, the springs will be isolated from the truck. Also, mounting means may be provided on the tops and bottoms of the springs to further damp any vibrations in the truck and springs.

What is claimed is:

1. In combination with a vertical mechanical spring mounted to a railway truck for supporting a car body, mounting means disposed on one end of said spring comprising:

(a) top and bottom plates spaced to receive an elastomeric ring therebetween;

(b) spaced cylindrical pieces attached to said top and bottom plates to receive an elastomeric ring therebetween;

(c) said cylindrical pieces with said second elastomeric ring extending into said vertical mechanical spring;

(d) a first elastomeric ring connected between said top and bottom plates to provide vertical compliance between said spring and said car body; and (e) a second elastomeric ring connected between said spaced cylindrical pieces to provide lateral compliance between said spring and said car body.

2. A combination as set forth in claim 1 wherein said mounting means is disposed on the top of said vertical mechanical spring between said spring and said car body.

3. A combination as set forth in claim 2 wherein said vertical spring includes a second vertical spring disposed therein.

4. A combination as set forth in claim 3 wherein said top and bottom plates include central openings therein.

5. A combination as set forth in claim 4 wherein said spaced cylindrical pieces extend downwardly into said vertical spring and said second vertical spring.

* * * * *